US006040775A

United States Patent [19]

Nill, Jr.

[11] Patent Number: 6,040,775

[45] Date of Patent: Mar. 21, 2000

[54] ROOF VENTS WITH MOISTURE DETECTORS AND ROOF SYSTEMS INCORPORATING SAME

[76] Inventor: Andrew J. Nill, Jr., 44A Lewis Ct., Huntington Station, N.Y. 11746

[21] Appl. No.: 09/081,177

[22] Filed: May 19, 1998

[51] Int. Cl.[7] ..... G08B 21/00

[52] U.S. Cl. ..... 340/604; 340/602; 340/605; 73/335.02

[58] Field of Search ..... 340/602, 604, 340/605; 324/696; 52/1, 173.1; 73/335.02, 335.06, 335.07, 40

[56] References Cited

U.S. PATENT DOCUMENTS

| | | | |
|---|---|---|---|
| 3,984,947 | 10/1976 | Patry | 52/1 |
| 4,020,478 | 4/1977 | Hatfield | 340/604 |
| 4,110,945 | 9/1978 | Sheahan | 52/173.1 |
| 4,553,000 | 11/1985 | Appleton | 200/50.29 |
| 4,723,109 | 2/1988 | Sheahan | 324/696 |
| 4,924,174 | 5/1990 | Sheahan | 324/696 |
| 5,036,859 | 8/1991 | Brown | 600/547 |
| 5,193,390 | 3/1993 | Nill, Jr. | 73/335.02 |
| 5,571,023 | 11/1996 | Anthony | 439/142 |
| 5,621,391 | 4/1997 | Elseth | 340/604 |

*Primary Examiner*—Daniel J. Wu
*Assistant Examiner*—Van T. Trieu
*Attorney, Agent, or Firm*—Galgano & Burke

[57] ABSTRACT

Roof vents include at least one moisture sensing element which is electrically coupled to an electrical connector in the roof vent. The electrical connector is located in the roof vent in such a manner that it is protected from the environment. A portable moisture sensing circuit or device with a moisture display for indicating a degree of moisture is provided with an electrical connector which mates with the electrical connector in the roof vent. According to the invention, the roof vents are installed in a roof system with the moisture sensors located below the roof insulation. When it is time to inspect the roof for leaks, a worker carries the portable device from one roof vent to another and plugs the device connector into the vent connector to take a moisture reading from the sensing element(s) associated with each vent. Since only one electrical circuit and display is used, the total cost of a system having many roof vents is significantly reduced. Preferred aspects of the invention include: locating the electrical connector on the vent so that it is easily and rapidly accessed but protected from the environment, associating a plurality of moisture sensing elements with a single vent, and arranging the plurality of moisture sensing elements in a star pattern.

17 Claims, 6 Drawing Sheets

ROOF VENTS WITH MOISTURE DETECTORS AND ROOF SYSTEMS INCORPORATING SAME

BACKGROUND OF THE INVENTION

1. Field of the Invention

The invention relates to a roof vent for a flat roof. More particularly, the invention relates to a roof vent with a moisture detector for the early detection of a roof leak and to a roof system incorporating several such vents.

2. State of the Art

Commercial, industrial, and institutional flat roof systems generally include several layers of material, i.e., a deck covered with lightweight insulating concrete, a vapor barrier covering the concrete, roofing insulation material covering the vapor barrier, a moisture barrier roof membrane covering the roofing insulation material, and a top layer of gravel, tar, ballast, etc. These watertight roof systems are generally effective at preventing water from passing through the roof system into the building. However, these systems can and do leak due to damage, material failure, or poor workmanship. When these types of roof systems leak, moisture tends to become trapped between the layers of the system where it remains undetected until substantial damage is done.

In order to prevent moisture from being trapped between the layers of a roof system, it is common to provide vents spaced throughout the roof system. FIG. 1 shows a prior art roof vent and FIG. 2 shows the vent installed in a conventional prior art roof system. The known vent 10 generally includes a circular base flange 12, an upstanding hollow frustroconical body 14 terminating with a cap 15, the cap and the body defining an annular opening into the body 14. The vent 10 is installed in a conventional roofing system 17 which may include, e.g., a deck 18, insulating concrete 26, a vapor barrier 23, and an upper waterproof membrane 22. The vent 10 is located such that the flange 12 is on top of the waterproof membrane 22 and is covered with flashing 24. The membrane 22 and the flashing 24 are covered with gravel, tar, ballast, etc. 25.

My prior U.S. Pat. No. 5,193,390, the complete disclosure of which is hereby incorporated herein by reference, discloses a modified roof vent and roof system which includes moisture detectors and moisture indicators. Prior art FIGS. 3–6 show the roof vents and roof system of the '390 patent. The roof vent 30 generally includes a circular base flange 34 with an upstanding hollow frustroconical body 32. The body 32 terminates with a cap 36 which is held in place by clamps 38 and which has a removable cover 36*a*. The cap 36 is provided with a shoulder 39 having openings 42 which provide a vapor passage to the interior of the body 32 via a hole 44 in a lower platform 46 of the cap 36. Preferably, a one-way diaphragm 45 is provided below the hole 44 which permits moisture to exit the body 32 but prevents moisture from entering. The cap 36 and the body 32 are sealed by mutually engaging ridges 48, 52.

As seen in prior art FIG. 3, the cap 36 has three interior platforms: lower platform 46, intermediate platform 54, and upper platform 58. The intermediate platform 54 includes a moisture indicator device or circuit 56 and the upper platform 58 includes a display 62 for indicating moisture such as a movable needle 64 which is coupled via an opening 66 to the device 56. The circuit or device 56 is electrically coupled to at least one moisture sensing element 68 by insulated conductors 72, 74. Moisture sensing elements of the type described in U.S. Pat. No. 4,110,945; 4,598,273; or 4,723,109 may be used and these prior U.S. patents are therefore incorporated herein by reference for their teaching of moisture sensors.

The vent 30 is installed in a roof system 63 as shown in prior art FIG. 4. The roof system 63 generally includes a deck 18' which is covered with a vapor barrier 23' which is covered with insulation 26' which is covered with a waterproof membrane 22'. The vent 30 is located with its flange 34 on top of the membrane 22' and an opening is made in the insulation 26' beneath the body 32 so that the moisture sensing element 68 may be placed directly upon the vapor barrier 23'. Preferably, a second moisture sensing element 76 is located between the insulation 26' and the waterproof membrane 22'. Both sensing elements are coupled in parallel to the indicator circuit 56.

The vent and roof system of my prior patent are effective in providing an early warning of roof leakage and in indicating where in a roof system a leak exists. According to the embodiment described (and illustrated in FIGS. 3 and 4, a periodic visual inspection is made of a roof where the cover 36*a* of each vent cap 36 is removed and the moisture indicator is inspected to determine whether the moisture sensing elements associated with the vent 30 are detecting moisture. A more sophisticated embodiment of my earlier invention is shown in prior art FIGS. 5 and 6. There each vent 80 is provided with a radio transmitter 82 and a radio receiver 84 is provided. According to this embodiment, each transmitter 82 transmits a unique signal when moisture is detected so that the receiver 84 will indicate not only that the roof 63 is leaking, but will indicate the approximate location of the leak.

The vent and roof system of my earlier patent work very well to achieve the objects for which they were designed. It is my intention to improve my earlier invention by making it more economical so that it may be utilized in a wider range of applications.

SUMMARY OF THE INVENTION

It is therefore an object of the invention to provide a roof vent with a moisture detector and roof systems incorporating such vents.

It is also an object of the invention to provide a roof vent with a moisture detector which is relatively inexpensive, easy to install, and easy to operate.

In accord with these objects which will be discussed in detail below, the roof vents of the present invention include at least one moisture sensing element which is electrically coupled to an electrical connector in the roof vent. The electrical connector is located in the roof vent in such a manner that it is protected from the environment. A portable moisture sensing circuit or device with a moisture display for indicating a degree of moisture is provided with an electrical connector which mate with the electrical connector in the roof vent. According to the invention, the roof vents are installed in a roof system in much the same manner as described in my earlier patent. When it is time to inspect the roof, a worker carries the portable device (which is typically battery operated) from one roof vent to another and plugs the device connector into the vent connector to take a moisture reading from the sensing element(s) associated with each vent. Thus, the procedure for inspecting the roof involves substantially the same time and effort as the first embodiment of my earlier invention, but it has a significant economic advantage. Since only one electrical circuit and display is used, the total cost of a system having many roof vents is significantly less than the systems according to my prior patent.

Preferred aspects of the invention include: locating the electrical connector on the vent so that it is easily and rapidly accessed but protected from the environment, associating a plurality of moisture sensing elements with a single vent, and arranging the plurality of moisture sensing elements in a star pattern. Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
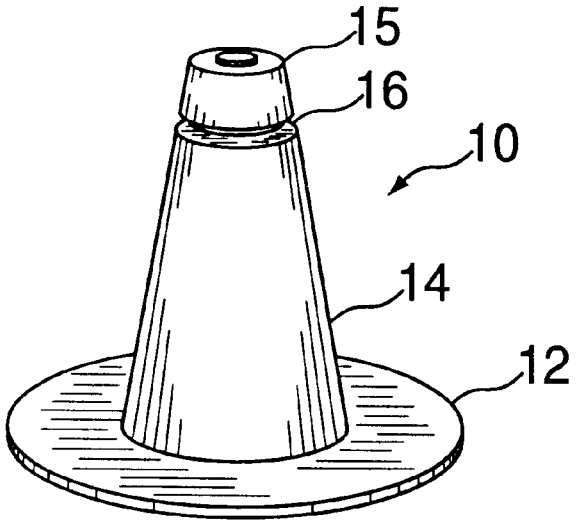
FIG. 1 PRIOR ART
FIG. 1 is a perspective view of a prior art roof vent.
Figure 2:
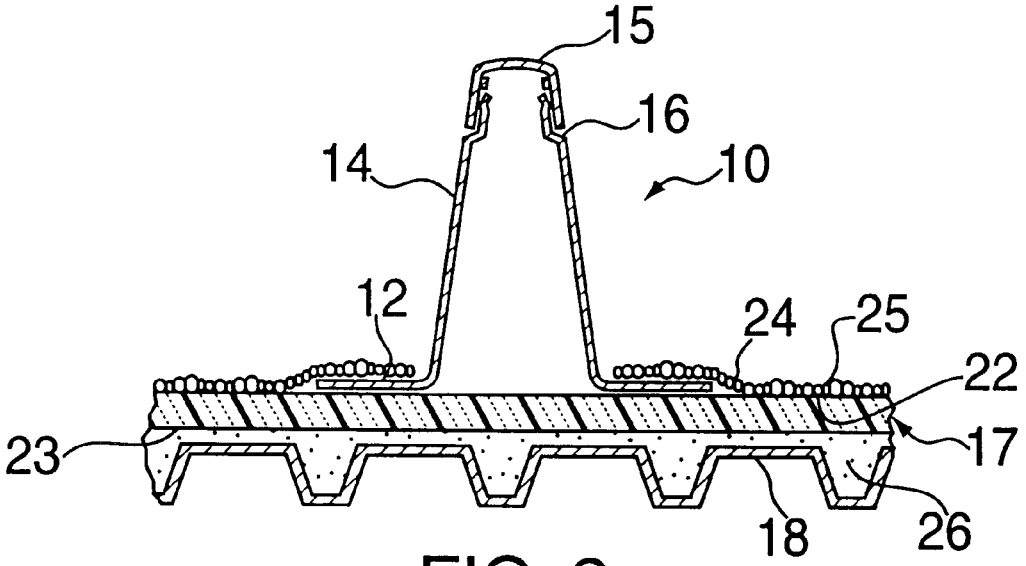
FIG. 2 PRIOR ART
FIG. 2 is a sectional view of the vent of FIG. 1 installed in a prior art roof system.
Figure 3:
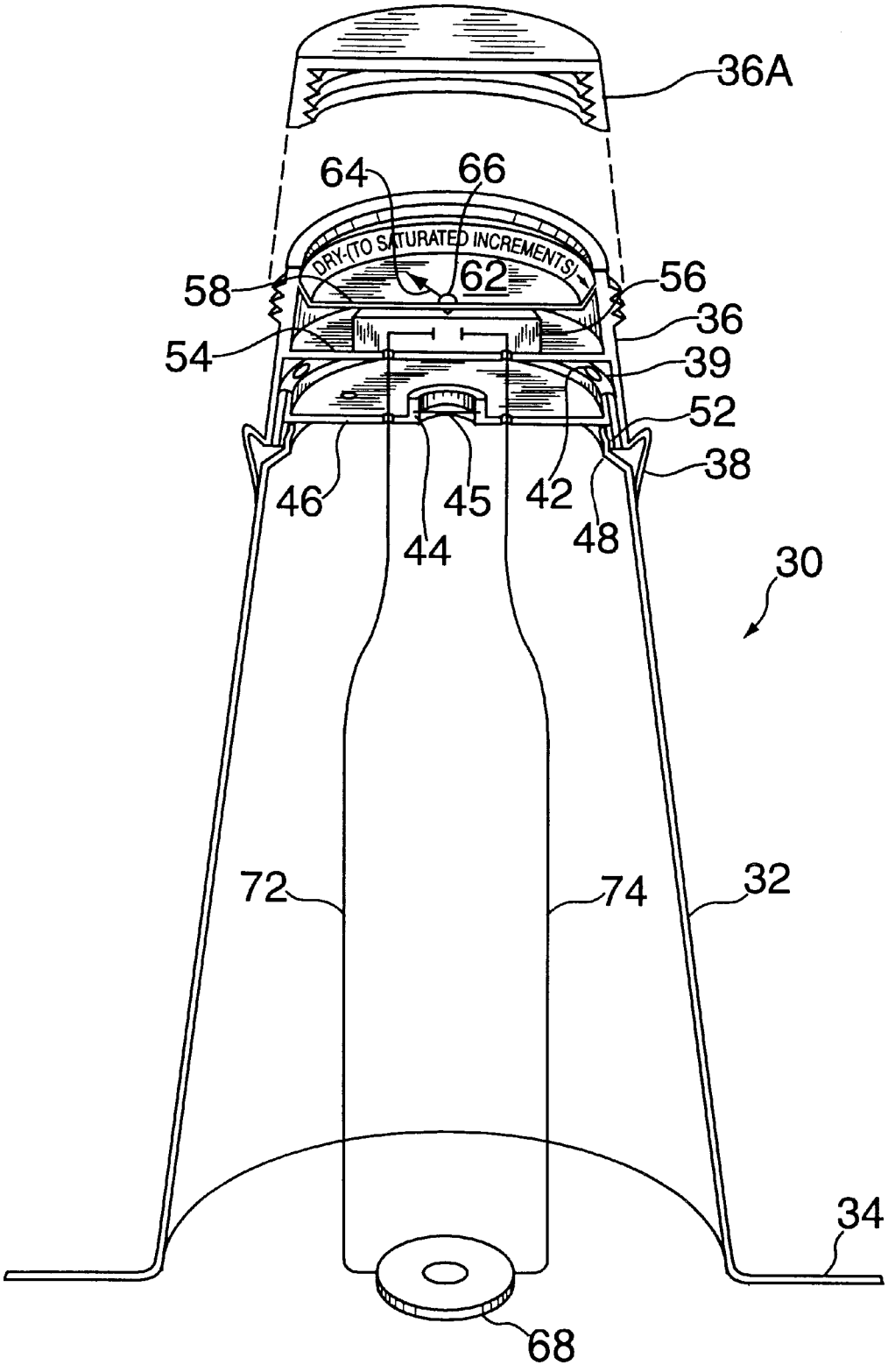
FIG. 3 PRIOR ART
FIG. 3 is an exploded perspective sectional view of a roof vent according to my prior U.S. Pat. No. 5,193,390.
Figure 4:
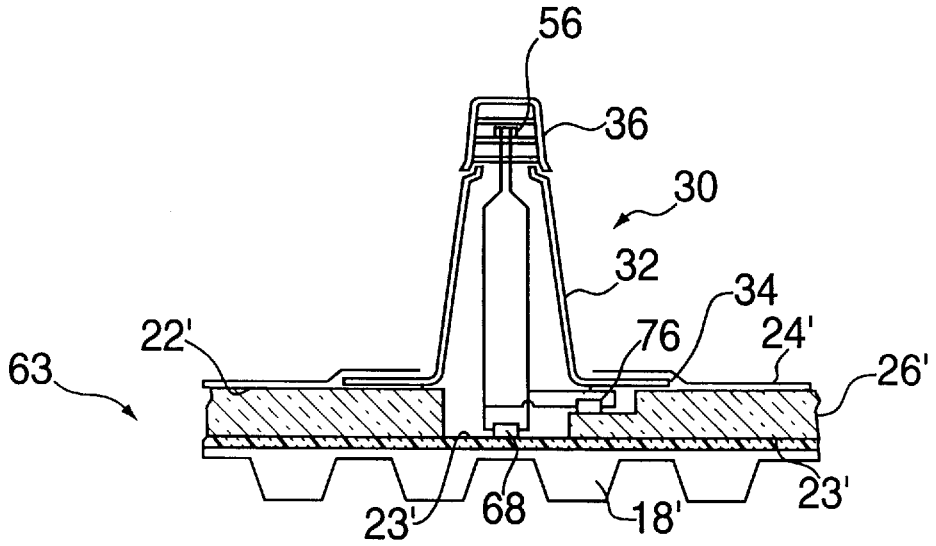
FIG. 4 PRIOR ART
FIG. 4 is a view similar to FIG. 2 showing a roof vent and roof system according to my prior U.S. Pat. No. 5,193,390.
Figure 5:
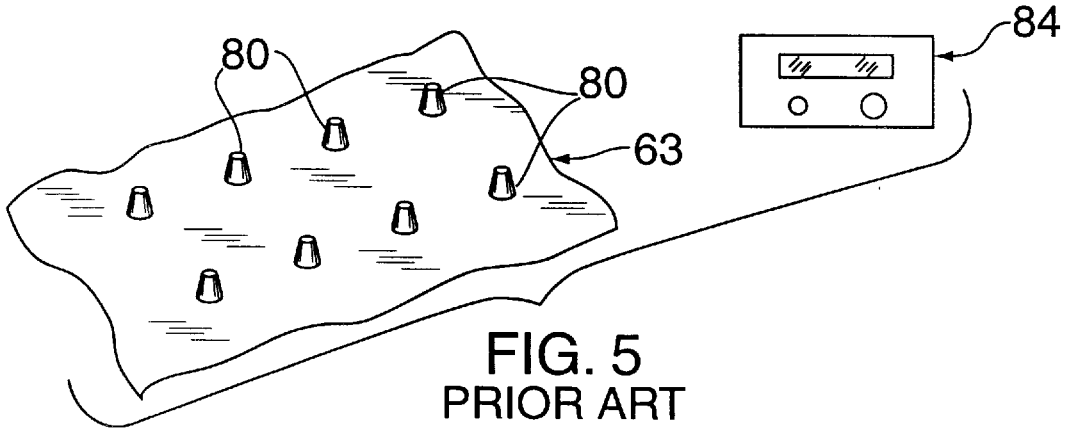
FIG. 5 PRIOR ART
FIGS. 5 and 6 are broken schematic views of a second embodiment of a roof vent and roof system according to my prior U.S. Pat. No. 5,193,390.
Figure 6:
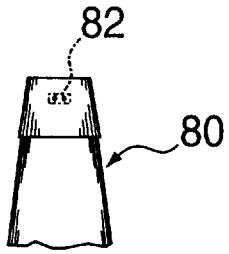
FIG. 6 PRIOR ART
Figure 7:
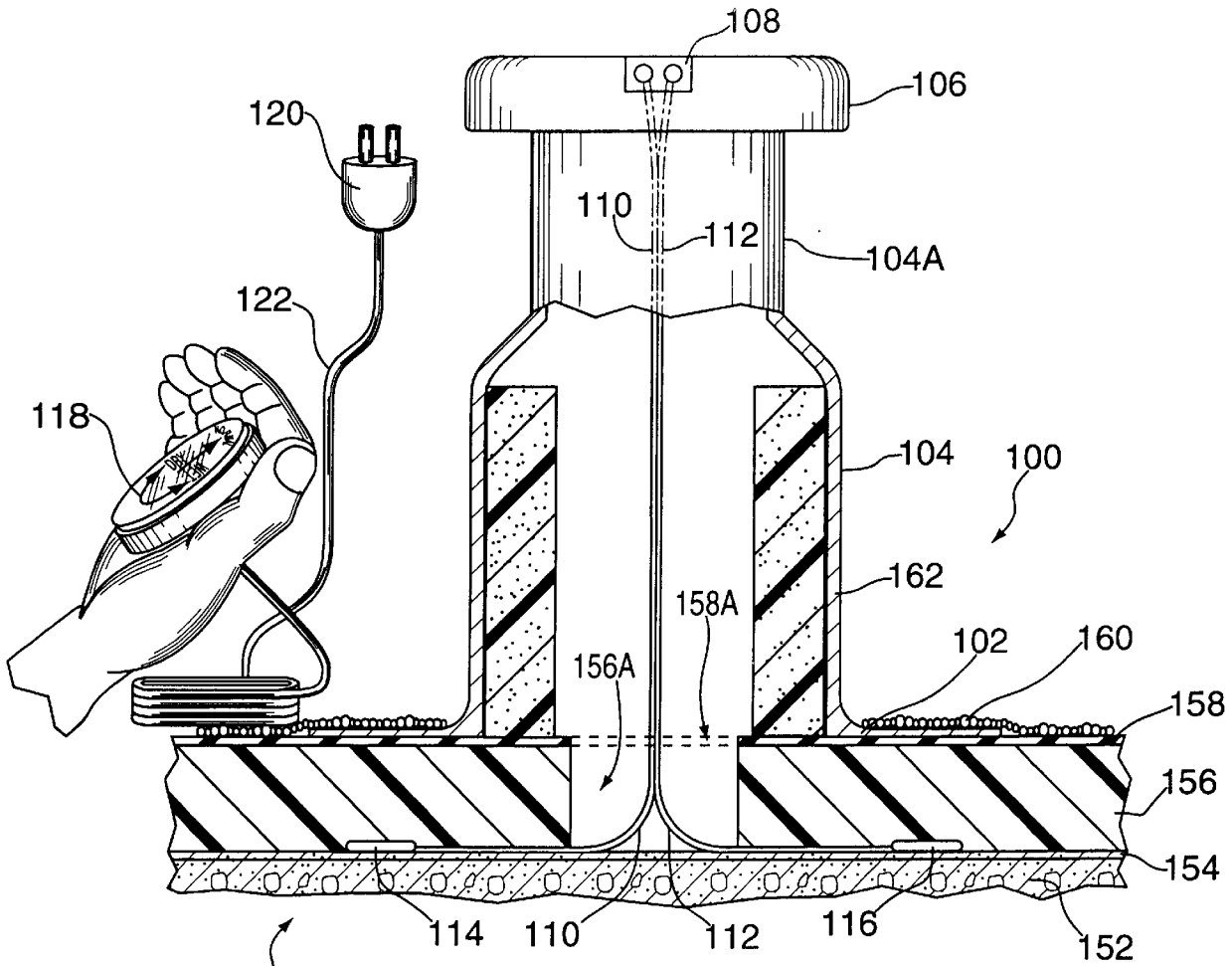
FIG. 7 is a schematic view of a roof vent and roof system according to a first embodiment of the present invention.
Figure 8:
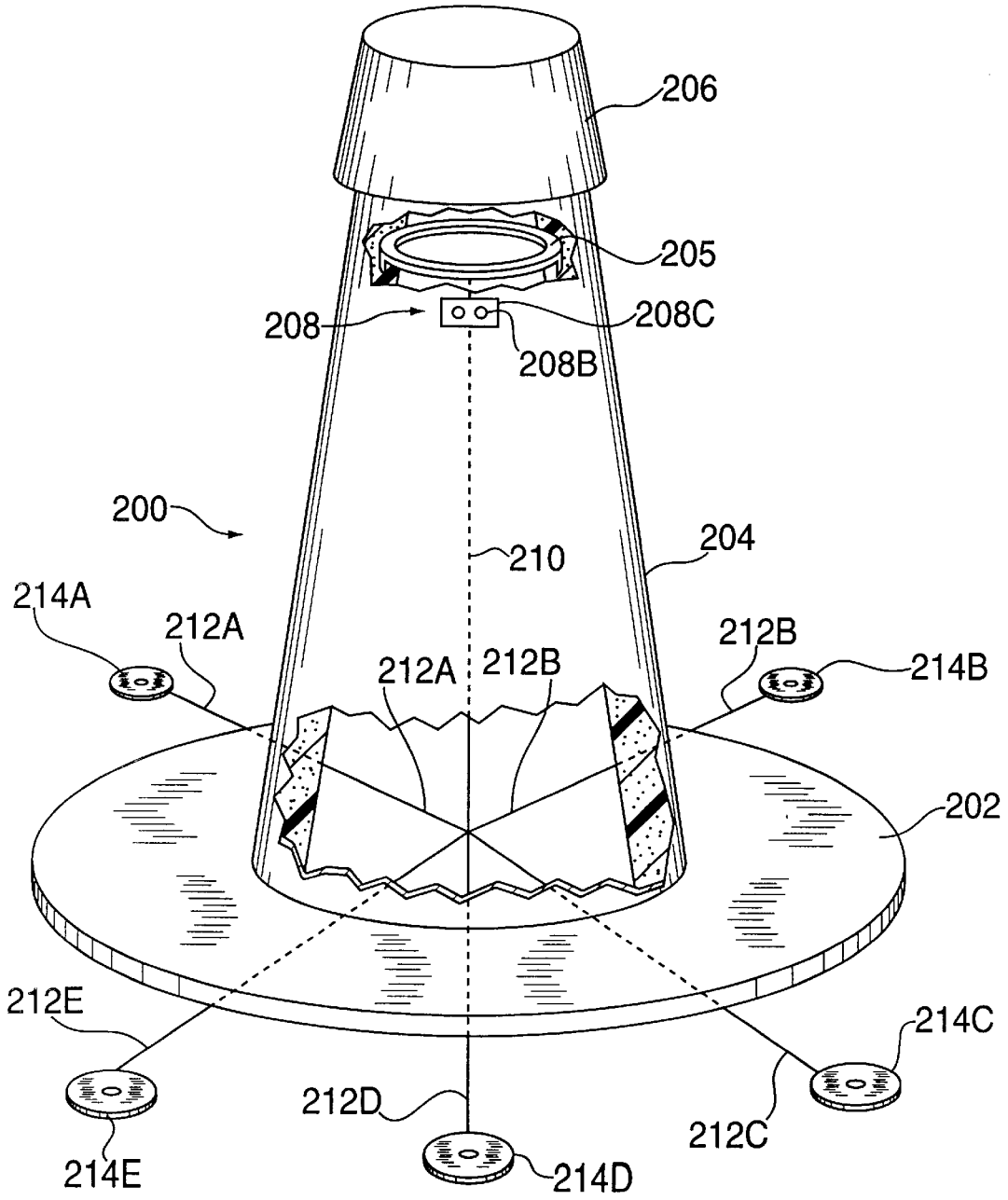
FIG. 8 is a schematic view of a roof vent according to a second embodiment of the present invention.
Figure 9:
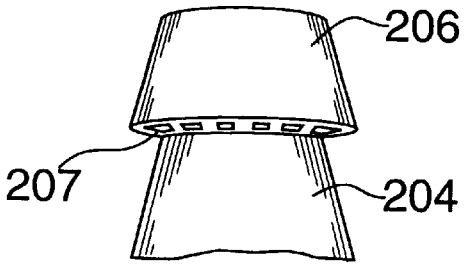
FIG. 9 is a broken perspective view of a portion of the vent of FIG. 8.
Figure 10A:
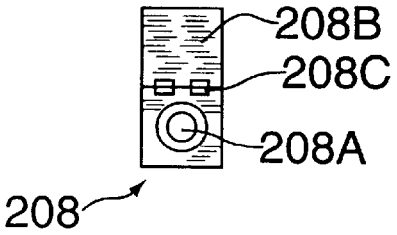
FIG. 10A is a schematic view of the electrical connector of the vent of FIG. 8.

Referring now to FIG. 7, a roof vent 100 according to a first embodiment of the invention includes a circular flange 102 with an upstanding cylindrical body 104 and a vent cap 106. The cap 106 is joined to the upper end 104*a* of the body 104 so as to provide an annular opening (not shown) into the interior of the body 104. In particular, according to this embodiment, the upper portion 104*a* of the body has a reduced diameter and the cap 106 has a diameter similar to the diameter of the lower portion of the body 104. A female electrical connector 108 is carried on a sidewall of the cap 106 and is coupled by insulated cables 110, 112 to a pair of moisture sensing elements 114, 116. According to the invention, a portable moisture sensing circuit/display 118 is provided with a male electrical connector 120 coupled to it by a cable 122. The connector 120 is designed to electrically mate with the connector 108. When the connectors are so mated, the moisture display 118 will indicate the amount of moisture sensed by the sensing elements 114, 116.

As shown in FIG. 7, the roof vent 100 is installed in a roof system 150 having several layers. In particular, the roof system 150 has a concrete deck 152 which is covered with a layer of tar 154, an insulation board 156, a layer of EPDM rubber 158, and a top layer of gravel, tar, ballast, etc. 160. According to the invention, an opening 156*a* is made in the insulation board 156 and an opening 158*a* in the EPDM rubber layer 158 so that the sensing elements 114, 116 may be placed between the tar layer 154 and the insulation board 156 with their electrical cables 110, 116 extending through the openings 156*a*, 158*a*. A cylinder 162 made of Styrofoam® or other insulating material is optimally placed in the openings 156*a*, 158*a* to minimize moisture condensation inside of the roof vent 100. The flange 102 of the vent 100 is placed on top of the EPDM rubber layer 158 under the top layer of gravel, tar, ballast, etc. 160.

Turning now to FIGS. 8–11, a second embodiment of a roof vent 200 of the invention includes a circular flange 202 with an upstanding tapered cylindrical body 204 terminating in a vent cap 206. The cap 206 is joined to the upper end of the body 204 so as to provide an annular opening (207 in FIG. 9) into the interior of the body 204. An electrical connector assembly 208 is carried on the sidewall of the body 204 and is coupled by insulated cables 210, 212*a*–*e* to five moisture sensing elements 214*a*–*e* which are arranges in a star pattern relative to the body 204. According to this embodiment of the invention, a baffle 205 is provided inside the body 204 and is equipped with a diaphragm (not shown) which prevents moisture from passing into the body 204 but allows moisture to vent out from the body 204. As seen best in FIG. 10A, the connector assembly 208 includes a female connector 208*a* which is mounted behind a cover 208*b* having hinges 208*c*. The cover 208*b* protects the connector 208*a* from the environment and the hinges 208*c* allow easy access to the connector 208*a*. Alternatively, as shown in FIG. 10B, the connector assembly 308 may include male connectors 308*a* surrounded by a raised annular ring 309 which are normally covered by a snap-on, cup-shaped cover 308*b* connected to the ring 309 via a thin band 310.

Figure 11:
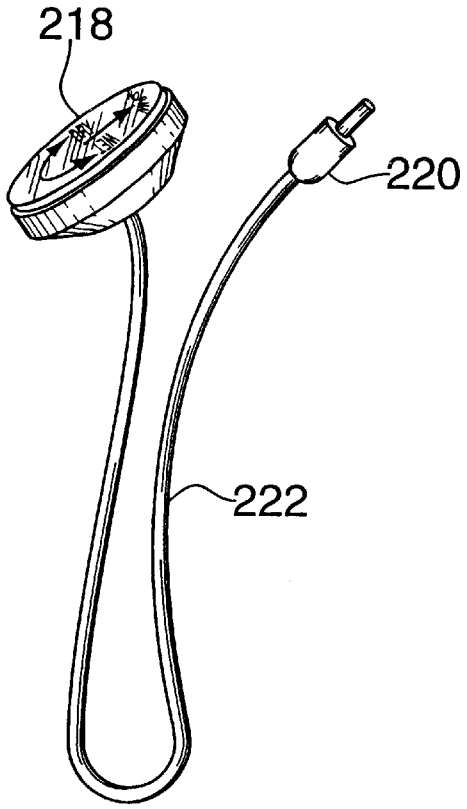
FIG. 11 is a perspective schematic view of a portable moisture detector/display according to the second embodiment of the invention.
Figure 10B:
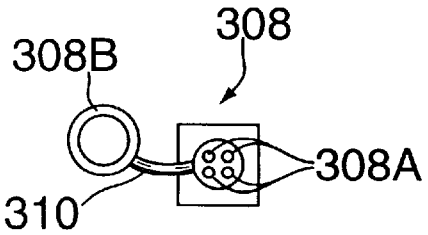
FIG. 10B is a schematic view of an alternate embodiment of the electrical connector of the vent of FIG. 8.

According to the invention, and as shown in FIG. 11, a portable moisture sensing circuit/display 218 is provided with a male electrical connector 220 coupled to it by a cable 222. The connector 220 is designed to electrically mate with the connector 208*a*. When the connectors are so mated, the moisture display 218 will indicate the amount of moisture sensed by the sensing elements 214*a*–*e*.

The roof vent 200 is mounted in a roof system in substantially the same manner as the vent 100 described above. The sensor elements 214*a*–214*e* are preferably arranged in a star pattern as shown. Depending on the nature of the roof system, more or fewer sensor elements may be used and the distance of each sensor element from the vent body may vary according to the nature of the roof system.

There have been described and illustrated herein several embodiments of a roof vent having moisture detectors and roof systems incorporating the same. While particular embodiments of the invention have been described, it is not intended that the invention be limited thereto, as it is intended that the invention be as broad in scope as the art will allow and that the specification be read likewise. Thus, while particular electrical connectors have been disclosed, it will be appreciated that other types of electrical connectors could be utilized. Also, while particular locations for the connectors on the vent have been shown, it will be recognized that other locations could be used with similar results obtained provided that the connector is protected from the environment and is easily accessible. Moreover, while particular configurations have been disclosed in reference to multiple sensor elements in a single vent with a single electrical connector, it will be appreciated that other configurations could be used as well. In particular it will be appreciated that where multiple sensor elements are deployed in conjunction with a single vent, multiple electrical connectors may be provided so that each sensor element may be read separately.

Furthermore, although the present invention is specifically intended for use with flat roofs, it could also be used for sloped roofs. In addition, while the present invention is intended to detect moisture within the roof system, it could be adapted for use as a moisture detector in attics or modular houses. In such a case, the moisture sensors would be positioned below the roof deck. For such an application, it would also be possible to use the moisture detector system of my previous patent in combination with an attic vent fan to vent moist air from the attic when the detector reaches a certain level. The detector would, in effect, serve as an automatic switch, or trigger, to turn on the fan when moisture level readings reached a certain undesirable level.

It will therefore be appreciated by those skilled in the art that yet other modifications could be made to the provided invention without deviating from its spirit and scope as so claimed.

What is claimed is:

1. A roof vent system for use in a roof having a plurality of layers of roofing material including a waterproof membrane, said roof vent system comprising:

a) a base flange dimensioned to fit in between two of the plurality of layers of roofing material;

b) an upstanding hollow member having an interior which hollow member is coupled to said base flange and terminating in a cap, said upstanding hollow member and said cap defining an annular opening into the interior of said hollow member;

c) a portable, battery-operated moisture indicating device having a first electrical connector;

d) electrical connector means mounted in one of said hollow member and said cap for releasably connecting with said first electrical connector; and e) at least one moisture sensing element electrically coupled to said electrical connector means and permanently mounted on one of the plurality of layers of roofing material.

2. A roof vent system according to claim 1, wherein:

said electrical connector means is a female coupling.

3. A roof vent system according to claim 1, wherein:

said electrical connector means is a male coupling.

4. A roof vent system according to claim 1, wherein:

said electrical connector means is shielded from the environment.

5. A roof vent system according to claim 1, wherein:

said electrical connector means is shielded from the environment by a hinged cover.

6. A roof vent system according to claim 1, wherein:

said at least one moisture sensing element includes a plurality of moisture sensing elements all connected to said electrical connector means.

7. A roof vent system according to claim 1, wherein:

said at least one moisture sensing element includes a plurality of moisture sensing elements and said electrical connector means includes a corresponding plurality of electrical connectors, one connector coupled to each sensing element.

8. A roof venting system for use in a roof having a plurality of layers of roofing material including a waterproof membrane, said system comprising:

a) a portable, battery-operated moisture indicating device having first electrical connector means for coupling to at least one moisture sensing element;

b) a plurality of roof vents, each vent including:

i) a base flange dimensioned to fit in between two of the plurality of layers of roofing material;

ii) an upstanding hollow member having an interior which hollow member is coupled to said base flange and terminating in a cap, said upstanding hollow member and said cap defining an annular opening into the interior of said hollow member;

iii) second electrical connector means mounted in one of said hollow member and said cap for releasably connecting with the first electrical connector; and iv) at least one moisture sensing element electrically coupled to said electrical connector means and permanently mounted on one of the plurality of layers of roofing material.

9. A system according to claim 8, wherein:

each of said second electrical connector means is shielded from the environment.

10. A system according to claim 8, wherein:

each of said second electrical connector means is shielded from the environment by a hinged cover.

11. A system according to claim 8, wherein:

said at least one moisture sensing element includes a plurality of moisture sensing elements all connected to said electrical connector means.

12. A system according to claim 8, wherein:

said at least one moisture sensing element includes a plurality of moisture sensing elements and said electrical connector means includes a corresponding plurality of electrical connectors, one connector coupled to each sensing element.

13. A vented roof system, comprising:

a) a roof having a plurality of layers of roofing material including a waterproof membrane;

b) a portably, battery-operated moisture indicating device having first electrical connector means for coupling to at least one moisture sensing element;

c) a plurality of roof vents, each vent including:

i) a base flange located in between two of the plurality of layers of roofing material;

ii) an upstanding hollow member having an interior which hollow member is coupled to said base flange and terminating in a cap, said upstanding hollow member and said cap defining an annular opening into the interior of said hollow member;

iii) second electrical connector means mounted in one of said hollow member and said cap for releasably connecting with the first electrical connector; and iv) at least one moisture sensing element electrically coupled to said electrical connector means and permanently mounted on one of the plurality of layers of roofing material.

14. A system according to claim 13, wherein:

each of said second electrical connector means is shielded from the environment.

15. A system according to claim 13, wherein:

each of said second electrical connector means is shielded from the environment by a hinged cover.

16. A system according to claim 13, wherein:

said at least one moisture sensing element includes a plurality of moisture sensing elements all connected to said electrical connector means.

17. A system according to claim 13, wherein:

said at least one moisture sensing element includes a plurality of moisture sensing elements and said electrical connector means includes a corresponding plurality of electrical connectors, one connector coupled to each sensing element.

* * * * *